US009257774B2

(12) United States Patent
Hirano et al.

(10) Patent No.: US 9,257,774 B2
(45) Date of Patent: Feb. 9, 2016

(54) CONNECTOR

(71) Applicant: Sumitomo Wiring Systems, Ltd., Yokkaichi (JP)

(72) Inventors: Shinji Hirano, Yokkaichi (JP); Yoshihiro Mizutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/519,189

(22) Filed: Oct. 21, 2014

(65) Prior Publication Data

US 2015/0118883 A1 Apr. 30, 2015

(30) Foreign Application Priority Data

Oct. 31, 2013 (JP) ..... 2013-226477

(51) Int. Cl.

| | |
|---|---|
| ***H01R 13/639*** | (2006.01) |
| ***H01R 13/629*** | (2006.01) |
| ***H01R 13/436*** | (2006.01) |
| ***H01R 4/18*** | (2006.01) |
| ***H01R 13/422*** | (2006.01) |

(52) U.S. Cl.

CPC ..... *H01R 13/4365* (2013.01); *H01R 4/185* (2013.01); *H01R 13/4223* (2013.01); *H01R 13/629* (2013.01); *H01R 13/639* (2013.01)

(58) Field of Classification Search

CPC ..... H01R 13/639; H01R 13/629; H01R 13/4365; H01R 13/4223

USPC ..... 439/304, 595

See application file for complete search history.

(56) References Cited

U.S. PATENT DOCUMENTS

| | | | | | |
|---|---|---|---|---|---|
| 5,397,249 | A * | 3/1995 | Endo | H01R 13/4368 | 439/595 |
| 5,575,683 | A * | 11/1996 | Saito | H01R 13/4365 | 439/595 |
| 7,112,104 | B2 * | 9/2006 | Sagawa | H01R 13/4365 | 439/595 |
| 7,114,999 | B2 | 10/2006 | Tsuji | | |
| 2002/0168895 | A1 * | 11/2002 | Suzuki | H01R 13/4365 | 439/595 |
| 2003/0027456 | A1 * | 2/2003 | Yamawaki | H01R 13/6273 | 439/595 |

* cited by examiner

*Primary Examiner* — James Harvey
*Assistant Examiner* — Oscar C Jimenez
(74) *Attorney, Agent, or Firm* — Gerald E. Hespos; Michael J. Porco; Matthew T. Hespos

(57) ABSTRACT

A connector (10) has a terminal accommodating portion (31) with a plurality of cavities (34) into which terminals (20) are accommodated from behind and a front holder (50) is mounted into the terminal accommodating portion (31). The front holder (50) includes locks (53) that move onto locked portions (49) on the upper surface of a narrow portion (45) of the terminal accommodating portion (31) when the front holder (50) is mounted into the terminal accommodating portion (31). The narrow portion (45) includes deformation preventing recesses (47) that fit to deformation preventing ribs (57) on the front holder (50) in a convexo-concave manner. The deformation preventing ribs (57) and the deformation preventing recesses (47) contact each other in a vertical direction when the locks (53) move onto the locked portions (49), thereby suppressing excessive deflection of the front holder (50) or the narrow portion (45).

7 Claims, 14 Drawing Sheets

CONNECTOR

BACKGROUND

1. Field of the Invention

The invention relates to a connector.

2. Description of the Related Art

U.S. Pat. No. 7,114,999 discloses a connector with a housing that includes a terminal accommodating portion. A fitting recess is provided in a central part of the terminal accommodating portion and receives a fitting portion provided on a mating housing. Cavities are provided at opposite upper and lower sides of the fitting recess and terminal fittings can be inserted into the cavities from behind.

A front holder is mounted into the housing and has locks that engage locked portions provided on the terminal accommodating portion at outer side surfaces at upper and lower outer sides of the cavities at the opposite upper and lower sides of the fitting recess. In the process of mounting the front holder into the housing, the locks of the front holder move onto the locked portions of the housing. When the front holder reaches a proper mount position, the locks move over the locked portions and are locked to the locked portions to hold the front holder in the housing.

Spaces, such as the cavities and the fitting recess, are provided inside the above-described terminal accommodating portion. As a result, areas of the terminal accommodating portion at inner sides of the locked portions may deform excessively toward the fitting recess and the terminal accommodating portion may incline excessively inward and deform plastically when the locks of the front holder move onto the locked portions of the housing. The fitting portion of the mating housing and the terminal accommodating portion may interfere with each other if the terminal accommodating portion is deformed plastically in this way. Consequently, the mating housing and the housing may be unable to connect.

Further, the front holder may open excessively outward and deform plastically when the locks move onto the locked portions and the front holder may remain open outwardly. Therefore locking margins between the locks and the locked portions may be reduced.

The invention was completed based on the above situation and aims to suppress plastic deformation of a terminal accommodating portion and a front holder.

SUMMARY OF THE INVENTION

The invention relates to a connector with a terminal accommodating portion made of synthetic resin and provided with cavities into which terminals are to be accommodated from behind. The connector also includes a front holder made of synthetic resin and mounted into the terminal accommodating portion. The front holder includes a lock that moves onto and over a locked portion on an outer surface of the terminal accommodating portion as the front holder is mounted to a proper mount position with respect to the terminal accommodating portion. The terminal accommodating portion includes an accommodating portion side deformation preventing portion to be fit to a holder side deformation preventing portion on the front holder in a convexo-concave manner. The holder side deformation preventing portion and the accommodating portion side deformation preventing portion contact each other in a direction in which the lock moves when the lock moves onto the locked portion, thereby suppressing excessive deflection of the front holder or the terminal accommodating portion.

The holder side deformation preventing portion and the accommodating portion side deformation preventing portion contact each other in the direction in which the lock moves onto the locked portion to suppress excessive or plastic deformation of the terminal accommodating portion toward inner spaces, such as the cavities. Further, plastic deformation of the front holder due to an excessive outward displacement is suppressed, thereby suppressing a reduction in a locking margin between the lock and the locked portion.

The accommodating portion side deformation preventing portion may be juxtaposed with the locked portion in a direction in which the holder side deformation preventing portion and the accommodating portion side deformation preventing portion contact each other, and may be arranged at an inner side of the locked portion in the terminal accommodating portion. The holder side deformation preventing portion may be juxtaposed with the lock in the direction in which the holder side deformation preventing portion and the accommodating portion side deformation preventing portion contact each other, and may be arranged at an inner side of the lock in the front holder. Thus, plastic deformation of the terminal accommodating portion arranged at the inner side of the locked portion can be suppressed reliably and outward plastic deformation of the front holder located at an outer side of the lock can be suppressed reliably.

The front holder may include a front wall forming a front part of the terminal accommodating portion. The accommodating portion side deformation preventing portion may be formed into a deformation preventing recess longer than the locked portion in a front-back direction and may be formed by recessing an outer surface of the terminal accommodating portion. The holder side deformation preventing portion may be a deformation preventing rib longer than the lock in the front-back direction and may project back from the front wall. The deformation preventing recess and the deformation preventing rib may be fit in a convexo-concave manner before the lock moves onto the locked portion.

According to such a configuration, the holder side deformation preventing portion and the accommodating portion side deformation preventing portion contact each other when the lock starts moving onto the locked portion. Thus, plastic deformation of the terminal accommodating portion and the front holder can be suppressed further as compared with the case where the holder side deformation preventing portion and the accommodating portion side deformation preventing portion contact each other after the lock starts moving onto the locked portion.

The front wall may include a front terminal accommodating portion forming one of the cavities and extending back. The deformation preventing rib may be continuous along the front terminal accommodating portion. Thus, the deformation preventing rib can be reinforced without separately providing a reinforcement for reinforcing the deformation preventing rib.

DETAILED DESCRIPTION

Figure 1:
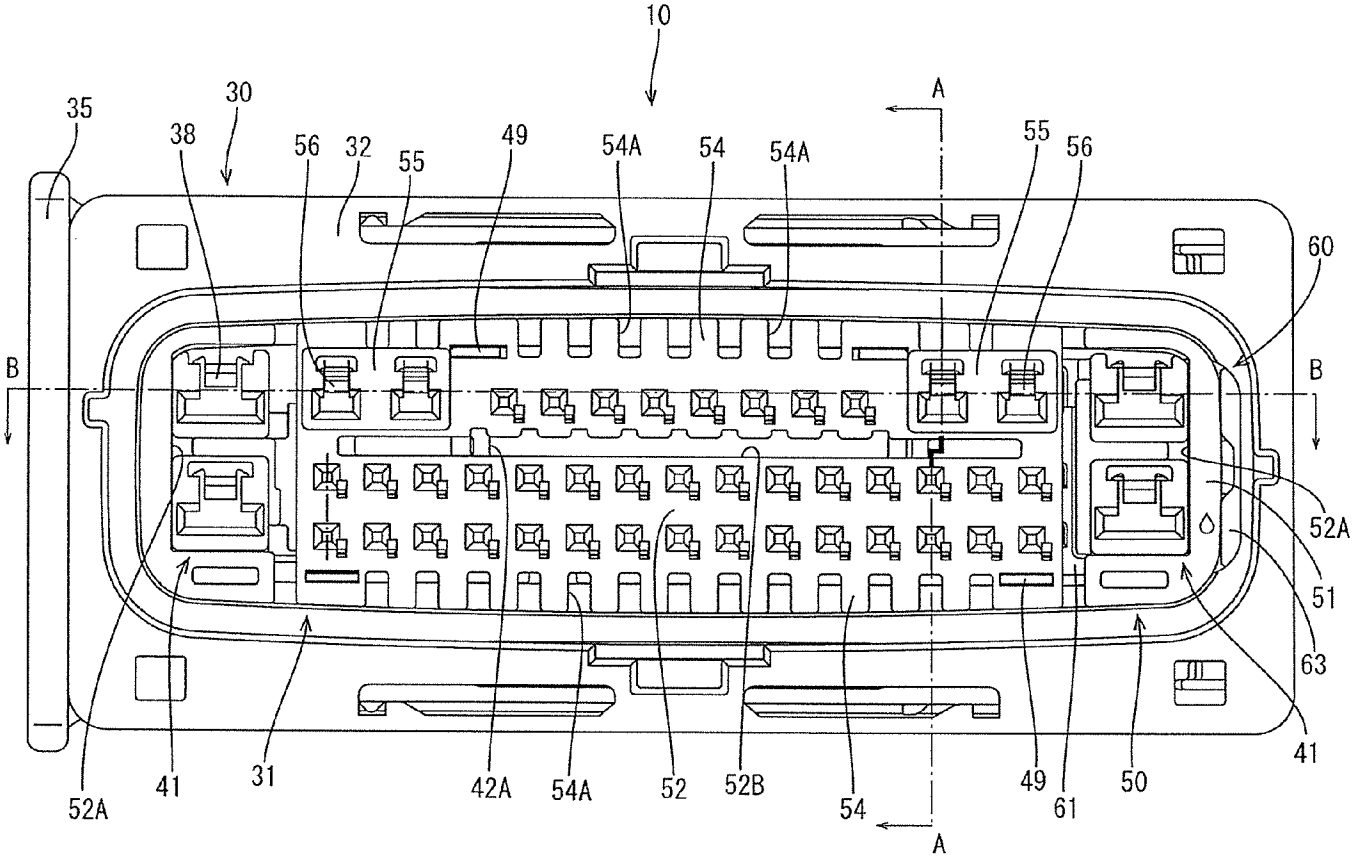
FIG. 1 is a front view of a connector.
Figure 2:
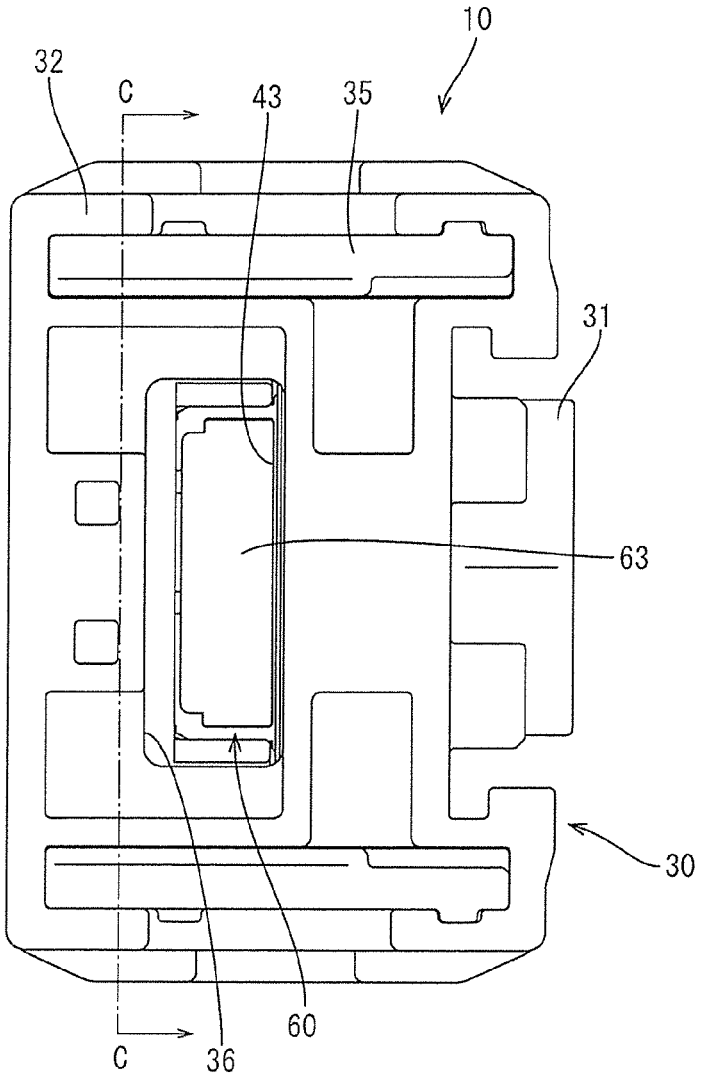
FIG. 2 is a side view of the connector.
Figure 3:
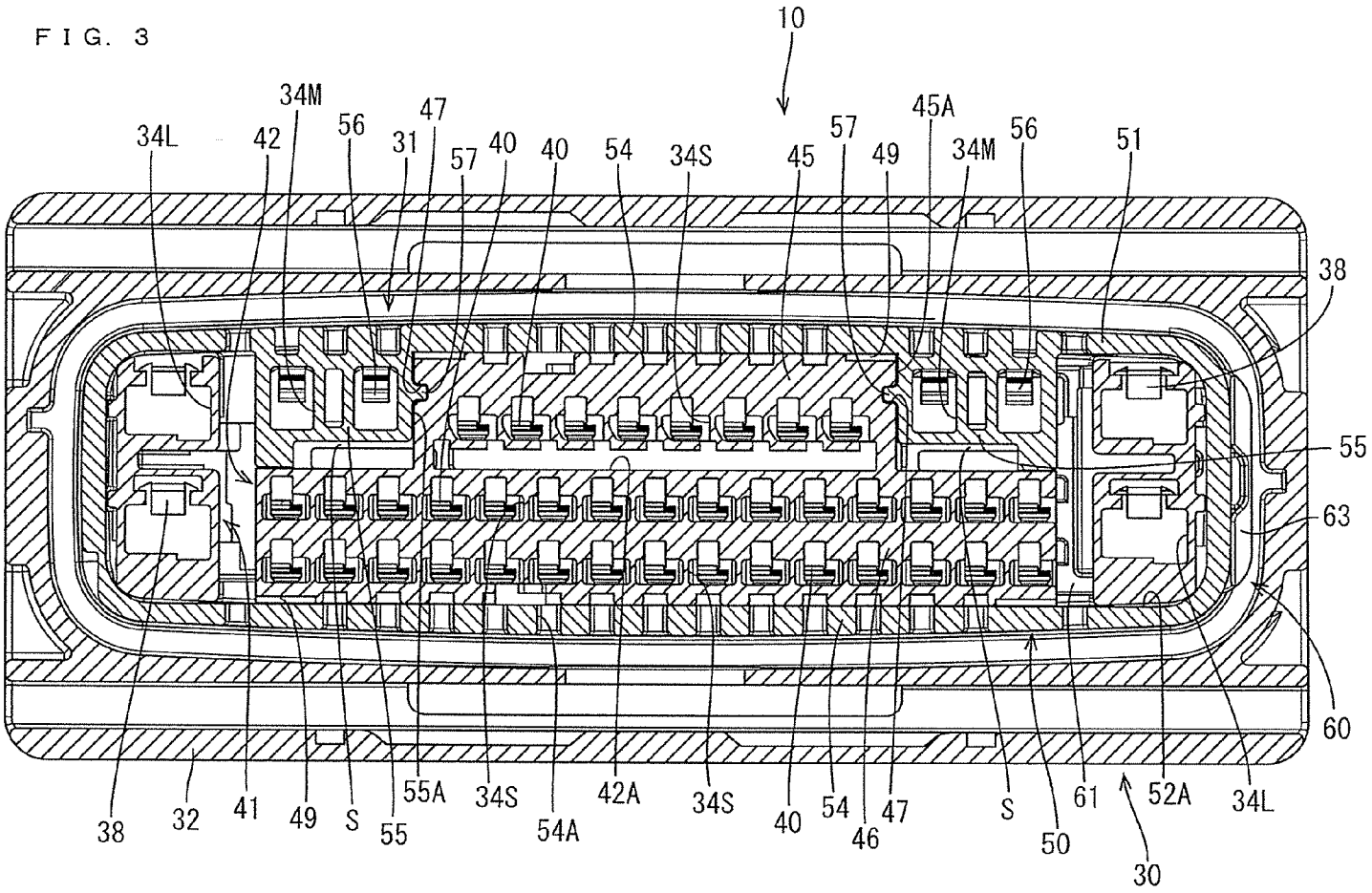
FIG. 3 is a section along line C-C of FIG. 2.
Figure 4:
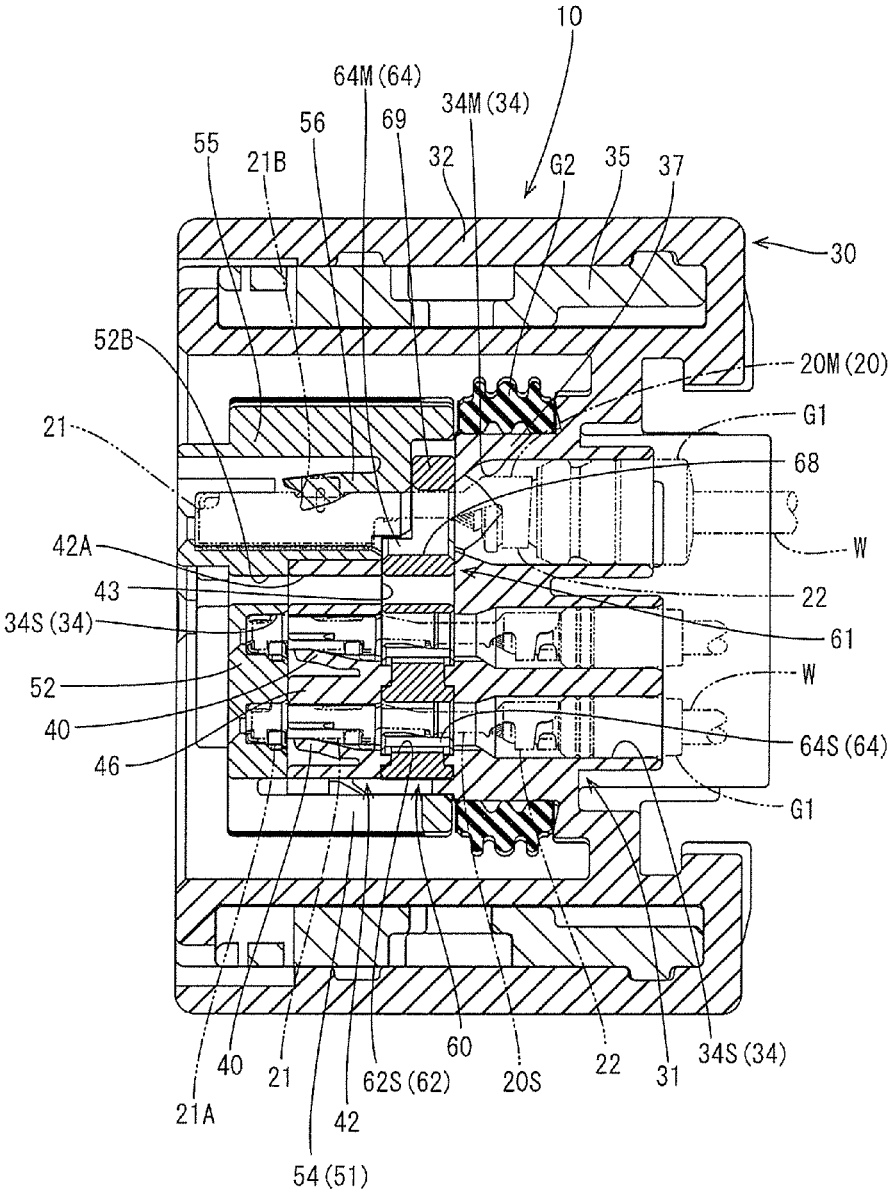
FIG. 4 is a section along line A-A of FIG. 1.

FIGS. 1 to 14 illustrate a hybrid-type connector 10 in which a plurality of types of terminals 20 are accommodated. As shown in FIGS. 1 and 4, the connector 10 includes small terminals 20S, medium terminals 20M and unillustrated large terminals. A wide housing 30 is configured to accommodate the terminals 20, and a retainer 60 can be inserted and withdrawn through a side surface of the housing 30. Note that, in the following description, a vertical direction is based on that in FIG. 1. Further, a front-back direction is based on FIG. 4, wherein left and right sides in FIG. 4 are front and rear ends.

Each terminal 20 is formed such as by press-working an electrically conductive metal plate material to define a tubular connecting portion 21 and a wire connecting portion 22 arranged one after the other, as shown in FIG. 4. The tubular connecting portion 21 is configured to connect with a male terminal (not shown). The wire connecting portion 22 is configured to connect to an end of a wire W. A rear part of the wire connecting portion 22 is crimped to an insulation coating of the wire W and a rubber plug G1 fit on the insulation coating.

As shown in FIGS. 3 to 6, the housing 30 includes a terminal accommodating portion 31 with a plurality of cavities 34 for accommodating the respective terminals 20. A receptacle 32 surrounds the outer surface of the terminal accommodating portion 31 over the entire periphery and a separate front holder 50 is mounted into the terminal accommodating portion 31 from the front. A mating receptacle (not shown) of the mating connector is fit between the terminal accommodating portion 31 and the receptacle 32.

As shown in FIG. 1, the receptacle 32 has a substantially rectangular opening in a front view. A laterally slidable slide lever 35 is accommodated at inner sides of a ceiling wall arranged on an upper side of the receptacle 32 and a bottom wall arranged on a lower side. The slide lever 35 is formed with unillustrated cam grooves, and the mating connector and the housing 30 are pulled toward each other to be connected by a cam action of unillustrated cam pins on the mating connector and the cam grooves by engaging the cam grooves and the cam pins and sliding the slide lever 35.

The receptacle 32 also has a retainer insertion hole 36 open on one side (front side of FIG. 2), and the retainer 60 can be inserted in and withdrawn from the retainer insertion hole 36.

Figure 5:
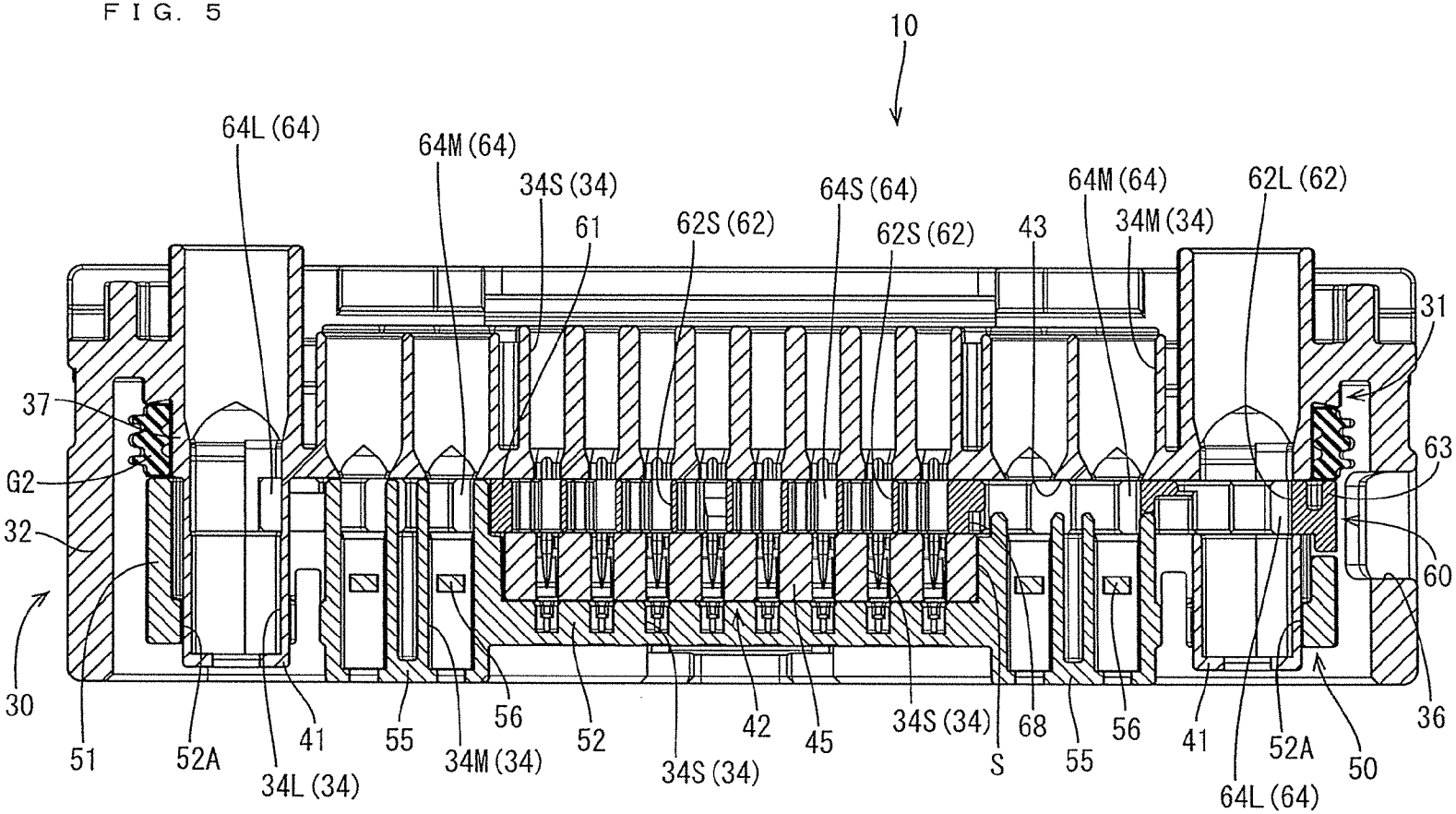
FIG. 5 is a section taken along line B-B of FIG. 1 showing the retainer at a full locking position.
Figure 6:
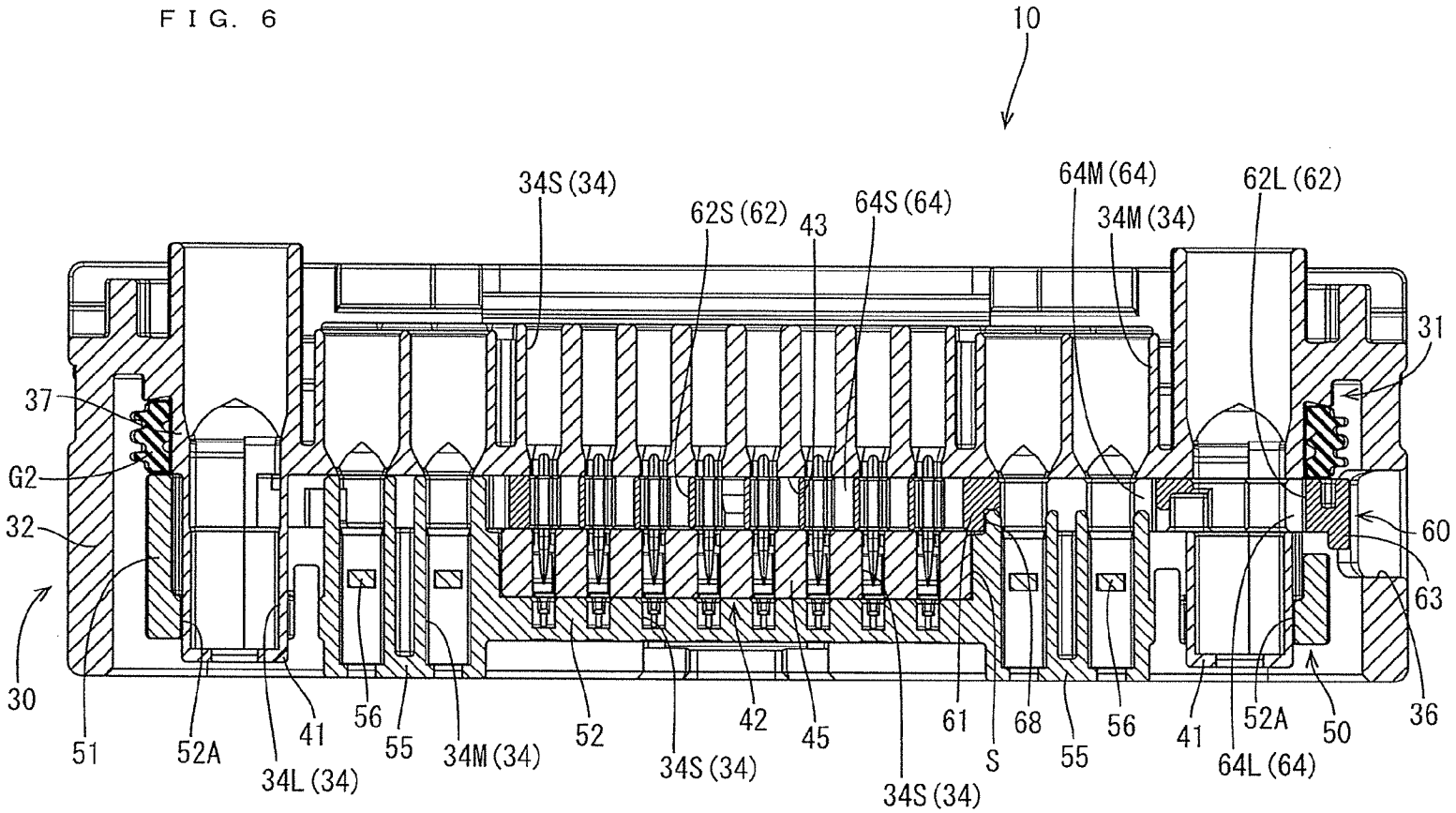
FIG. 6 is a section along line B-B of FIG. 1 showing the retainer held at a partial locking position.
Figure 7:
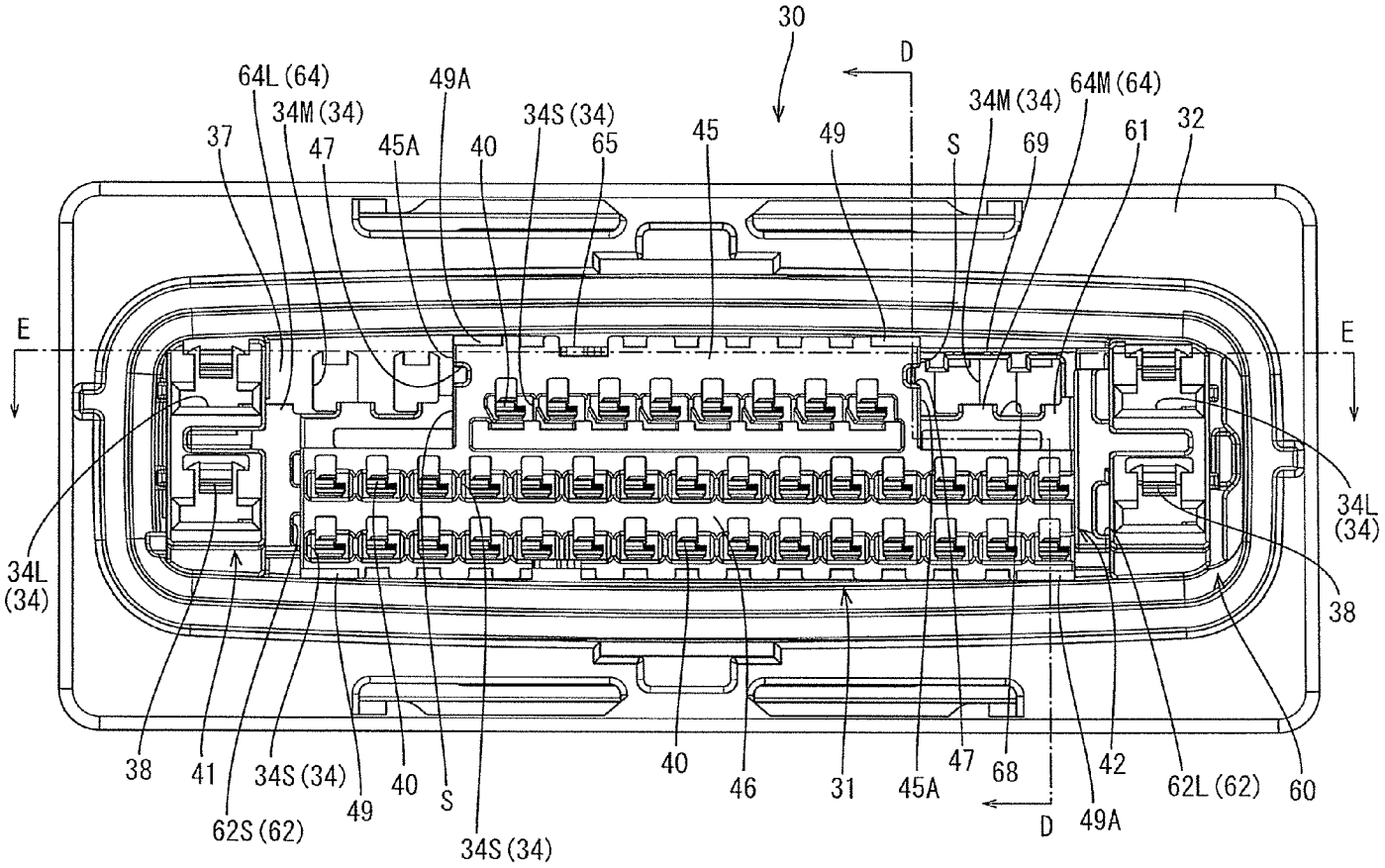
FIG. 7 is a front view of a housing before a front folder is mounted.

The terminal accommodating portion 31 is wide in the lateral direction, as shown in FIGS. 5 to 7, and a rear end part of the terminal accommodating portion 31 defines a seal tower 37 on which a rubber ring G2 is fit externally, as shown in FIGS. 4 to 6. The rubber ring G2 closely contacts the outer peripheral surface of the seal tower 37 and the inner peripheral surface of the mating receptacle to seal between the terminal accommodating portion 31 and the mating receptacle when the mating receptacle is fit between the terminal accommodating portion 31 and the receptacle 32.

Large cavities 34L for accommodating the large terminals (not shown), medium cavities 34M for accommodating the medium terminals 20M and small cavities 34S for accommodating the small terminals 20S are formed in a mixed manner in the seal tower 37. As shown in FIG. 7, the large cavities 34L are provided in upper and lower stages on opposite lateral side parts of the seal tower 37, and the small cavities 34S are provided side by side in the lateral direction in each of upper, middle and lower stages between the large cavities 34L on the left and right end parts. The number of the small cavities 34S in the upper stage is slightly less than the number of small cavities 34S in the middle and lower stages. Two medium cavities 34M are arranged laterally side by side at opposite left and right sides of the small cavities 34S in the upper stage.

As shown in FIG. 4, each of the large, medium and small cavities 34 penetrates the seal tower 37 in the front-back direction and the terminal 20 is inserted therein from behind. A rear end of each cavity 34 defines a round hole. The rubber plug G1 on the wire W closely contacts the inner peripheral surface of a rear end of the cavity 34 to seal between the wire W and the terminal accommodating portion 31, as shown in FIG. 4, when the terminal 20 is accommodated in the respective cavity 34.

Lateral towers 41 project forward on opposite lateral end parts of the seal tower 37, and a central tower 42 projects forward from a position on the seal tower 37 is provided between the lateral towers 41.

As shown in FIGS. 5 and 6, a retainer accommodation hole 43 is provided in the central tower 42 and the lateral towers 41 for accommodating the retainer 60 inserted through the retainer insertion hole 36 of the receptacle 32.

The retainer accommodation hole 43 extends in the lateral direction from the lateral tower 41 on the side with the retainer insertion hole 36 (right side in FIGS. 5 and 6) to the other lateral tower 41 on the side opposite the retainer insertion hole 36 (left side in FIGS. 5 and 6) through the central tower 42. Further, the retainer accommodation hole 43 is provided on base ends of the central tower 42 and the lateral towers 41 so that the front end surface of the seal tower 37 becomes the inner rear surface of the retainer accommodation hole 43. The retainer 60 is accommodated into the retainer accommodation hole 43 from the one side toward the other side in a direction intersecting an accommodating direction of the terminals 20 while the rear surface of the retainer 60 and the front end surface of the seal tower 37 slide on each other.

Figure 9:
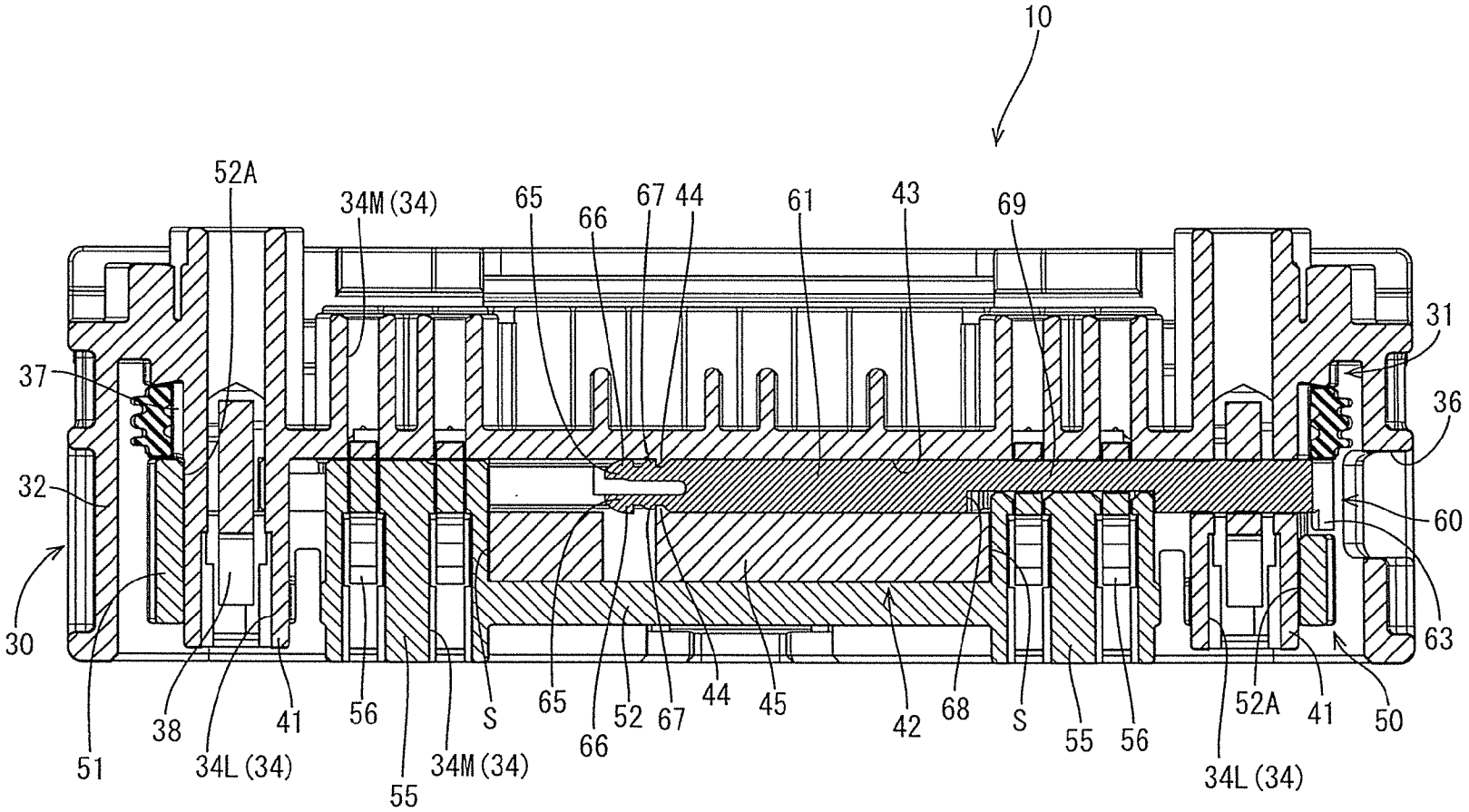
FIG. 9 is a section of the connector taken along line E-E of FIG. 7 with the retainer at the full locking position.

The retainer 60 is slidably displaceable in the lateral direction in the retainer accommodation hole 43 laterally between a partial locking position where each terminal 20 is insertable and withdrawable (see FIGS. 6 and 10) and a full locking position where each terminal 20 is locked (see FIGS. 5 and 9). Further, as shown in FIG. 11, the retainer 60 includes a flat plate-shaped retainer main body 61 with terminal insertion holes 62, each of which includes a terminal lock 64. An operating portion 63 is provided on one side part (right side of FIGS. 11 and 12) of the retainer main body 61. Large terminal locks 64L are provided on the other side part (left side of FIGS. 11 and 12) of the retainer main body 61 and enter the lateral tower 41 on the other side to lock rear ends of connecting parts of the large terminals.

The operating portion 63 projects slightly forward from a side of the retainer main body 61 and can be pushed to insert the retainer 60 into the retainer accommodation hole 43 and to move the retainer 60 from the partial locking position to the full locking position. The operating portion 63 also can be operated to pull the retainer 60 from the full locking position to the partial locking position and from the retainer accommodation hole 43.

Figure 10:
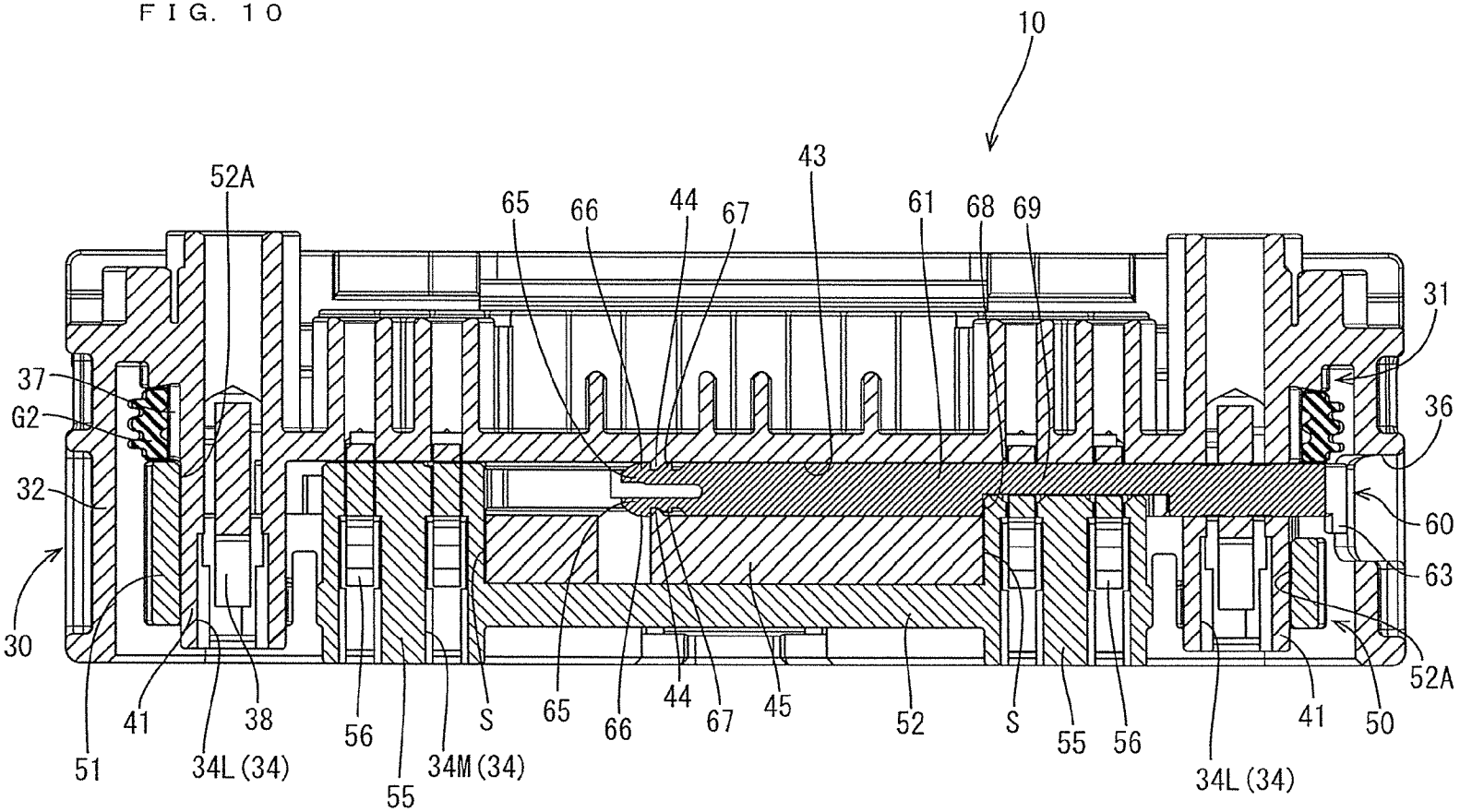
FIG. 10 is a section of the connector taken along line E-E of FIG. 7 with the retainer at the partial locking position.
Figure 11:
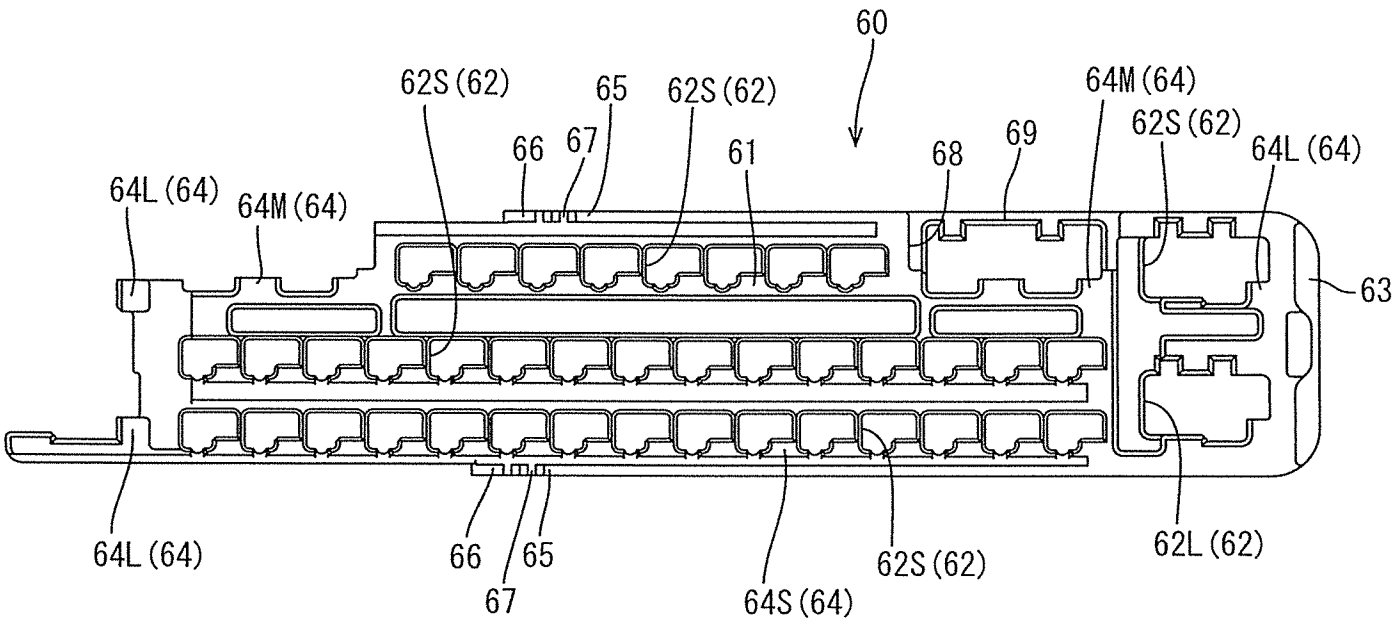
FIG. 11 is a front view of the retainer.

As shown in FIGS. 9 and 10, front and rear locking pieces 65 are provided respectively on the upper and lower surfaces of the retainer main body 61 and are lockable to front and rear locked portions 44 projecting into the retainer accommodation hole 43. As shown in FIGS. 9 to 12, the locking pieces 65 are provided on back parts of the upper and lower surfaces of the retainer main body 61 in an inserting direction of the retainer 60 and are resiliently displaceable toward each other. Each locking piece 65 includes a partial locking claw 66 for holding the retainer 60 at the partial locking position by engaging the locked portion 44 and a full locking claw 67 for holding the retainer 60 at the full locking position by being locked to the locked portion 44.

The operating portion 63 is pushed to displace the locking pieces 65 resiliently. Thus, the full locking claws 67 move over the locked portions 44 and are locked to the locked portions 44 in the lateral direction to hold the retainer 60 at the full locking position. Further, the operating portion 63 is pulled to resiliently displace the locking pieces 65 so that the full locking claws 67 move over the locked portions 44 and the partial locking claws 66 are locked to the locked portions 44 in the lateral direction to hold the retainer 60 at the partial locking position.

The insertion holes 62 in a central part of the retainer main body 61 are small terminal insertion holes 62S and communicate with the small cavities 34S of the seal tower 37. The small terminal insertion hole 62S are arranged laterally in each of upper, middle and lower stages. A small terminal lock 64S is provided on the lower surface of the small terminal insertion hole 62S and a rear end part of the connecting portion 21 of the small terminal 20S is locked by the small terminal lock 64S when the retainer 60 is at the full locking position.

The terminal insertion holes 62 also include large terminal insertion holes 62L arranged in upper and lower stages between the small terminal insertion holes 62S of the retainer main body 61 and the operating portion 63. The large terminal insertion holes 62L communicate with the large cavities 34L in the seal tower 37. A large terminal lock 64L is provided on the upper surface of the large terminal insertion hole 62L and a rear end part of the connecting portion of the large terminal is locked by the large terminal locking portion 64L when the retainer 60 is at the full locking position.

As shown in FIGS. 5 and 6, an escaping portion 68 is provided between the small terminal insertion holes 62S and the large terminal insertion hole 62L in the upper stage of the retainer main body 61 and can receive a front terminal accommodating portion 55 of the front holder 50 to avoid the interference of the front terminal accommodating portion 55 and the retainer main body 61.

As shown in FIG. 4, the escaping portion 68 is formed by recessing the retainer main body 61 back in a plate thickness direction of the retainer main body 61 from the front end surface and down from the upper end surface of the retainer main body 61. Thus, the escaping portion 68 is open on the upper end of the retainer main body 61 and is substantially U-shaped in a front view, as shown in FIG. 11.

Figure 12:
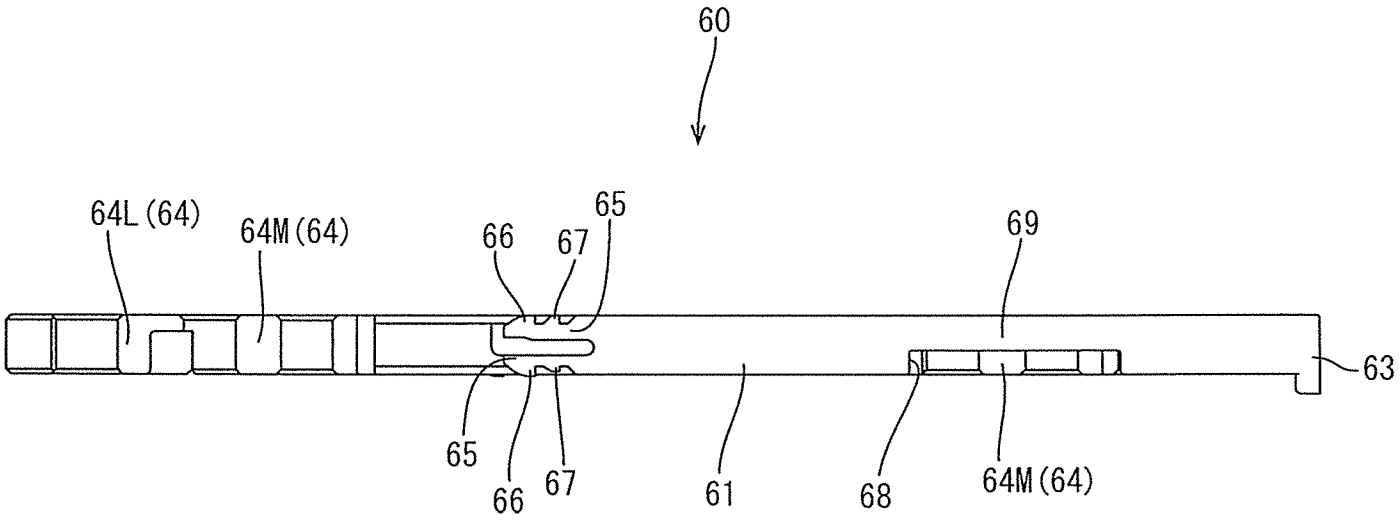
FIG. 12 is a plan view of the retainer.

As shown in FIGS. 9, 10 and 12, a reinforcement 69 is provided on an upper part of the escaping portion 68 for closing a rear half of an upper end opening of the escaping portion 68. As shown in FIG. 11, the reinforcement 69 couples opposite lateral end parts of the upper end opening of the escaping portion 68 in the lateral direction and is flush with the upper end surface of the retainer main body 61.

Specifically, the presence of the escaping portion 68 in the retainer main body 61 between the locking pieces 65 and the operating portion 63 raises a concern that the retainer main body 61 may be deformed to squeeze the escaping portion 68 in the lateral direction by operating forces on the operating portion 63 of the retainer 60. However, the reinforcement 69 couples opposite sides of the upper end opening of the escaping portion 68 in the lateral direction to prevent squeezing of the escaping portion 68. Therefore the retainer main body 61 can be moved correctly in the lateral direction between the partial locking position and the full locking position.

Medium terminal locks 64M for locking rear end parts of the connecting portions 21 of the medium terminals 20M are provided on the bottom surface of the escaping portion 68. The rear end parts of the connecting portions 21 of the medium terminals 20M are locked by the medium terminal locking portions 64M when the retainer 60 is at the full locking position. Thus, the terminal locks 64 of the retainer main body 61 lock the rear parts of the connecting portion 21 of each terminal 20 while the respective large, medium and small terminals 20 are accommodated in a mixed manner in the terminal accommodating portion 31.

As shown in FIG. 1, each lateral tower 41 is a tube having a vertically long substantially rectangular shape in a front view. As shown in FIG. 3, large cavities 34L are provided in upper and lower stages in the lateral tower 41 and communicate with the large cavities 34L of the seal tower 37 in the front-back direction. A large locking lance 38 is cantilevered from the upper surface of the large cavity 34L in the lateral tower 41 and is resiliently displaceable in the vertical direction. The large locking lance 38 engages the connecting portion of the large terminal that has been inserted into the large cavity 34L and prevents the large terminal from coming out backward.

An upper half of the central tower 42 defines a narrow portion 45, and a lower half defines a wide portion 46 that is wider than the narrow portion 45. Small cavities 34S are arranged laterally in upper, middle and lower stages in the central tower 42 a positions corresponding to the small cavities 34S of the seal tower 37 in the front-back direction. The small cavities 34S in the upper stage are arranged in the narrow portion 45 and those 34S in the middle and lower stages are arranged in the wide portion 46.

A wide fitting recess 42A is provided between the small cavities 34S of the narrow portion 45 and the small cavities 34S of the wide portion 46, and a fitting plate on the mating connector is fit into the fitting recess 42A.

Parts of the small terminals 20S behind front end parts are accommodated respectively in the small cavities 34S of the central tower 42 and the seal tower 37, as shown in FIG. 4, and cantilevered small locking lances 40 are cantilevered obliquely up toward the front from the lower surfaces of the small cavities 34S in the central tower 42. The small locking lance 40 is resiliently displaceable in the vertical direction as the small terminal 20S is inserted into the small cavity 34S. The small locking lance 40 then engages a lance locking portion 21A on the connecting portion 21 of the small terminal 20S so that the small terminal 20S does not come out backward.

Arrangement spaces S are formed at opposite lateral sides of the narrow portion 45 of the terminal accommodating portion 31, as shown in FIGS. 5 and 7, and can receive the front holder 50 from the front. As shown in FIGS. 1, 3 to 6 and 8, the front holder 50 includes a surrounding portion 51 for surrounding the terminal accommodating portion 31 over the entire periphery, a front wall 52 to be mounted on the front end surface of the central tower 42 and front terminal accommodating portions 55 to be arranged in the arrangement spaces S of the terminal accommodating portion 31.

Figure 13:
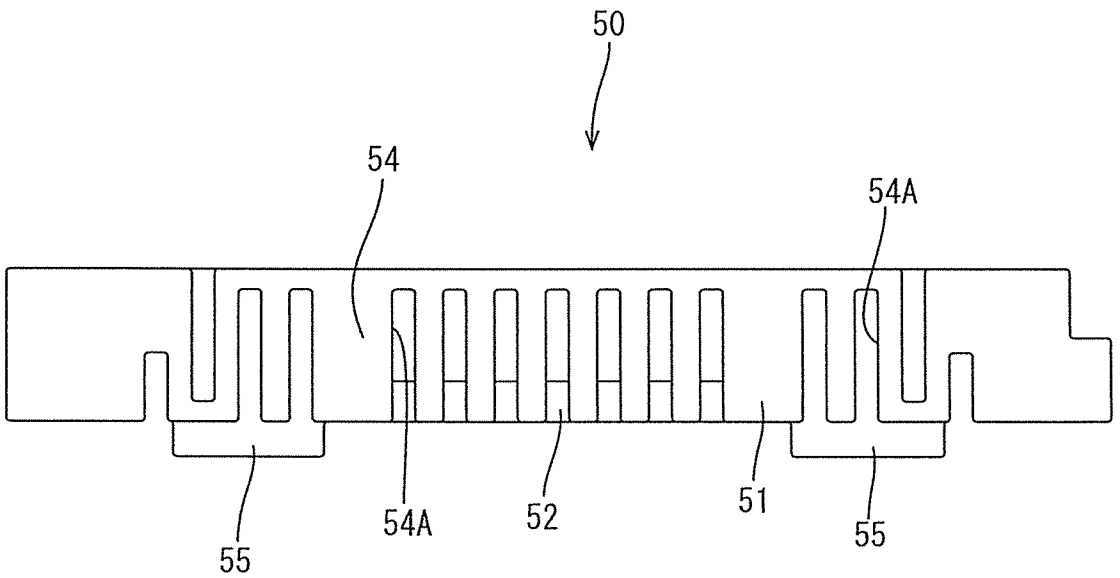
FIG. 13 is a plan view of the front holder.
Figure 14:
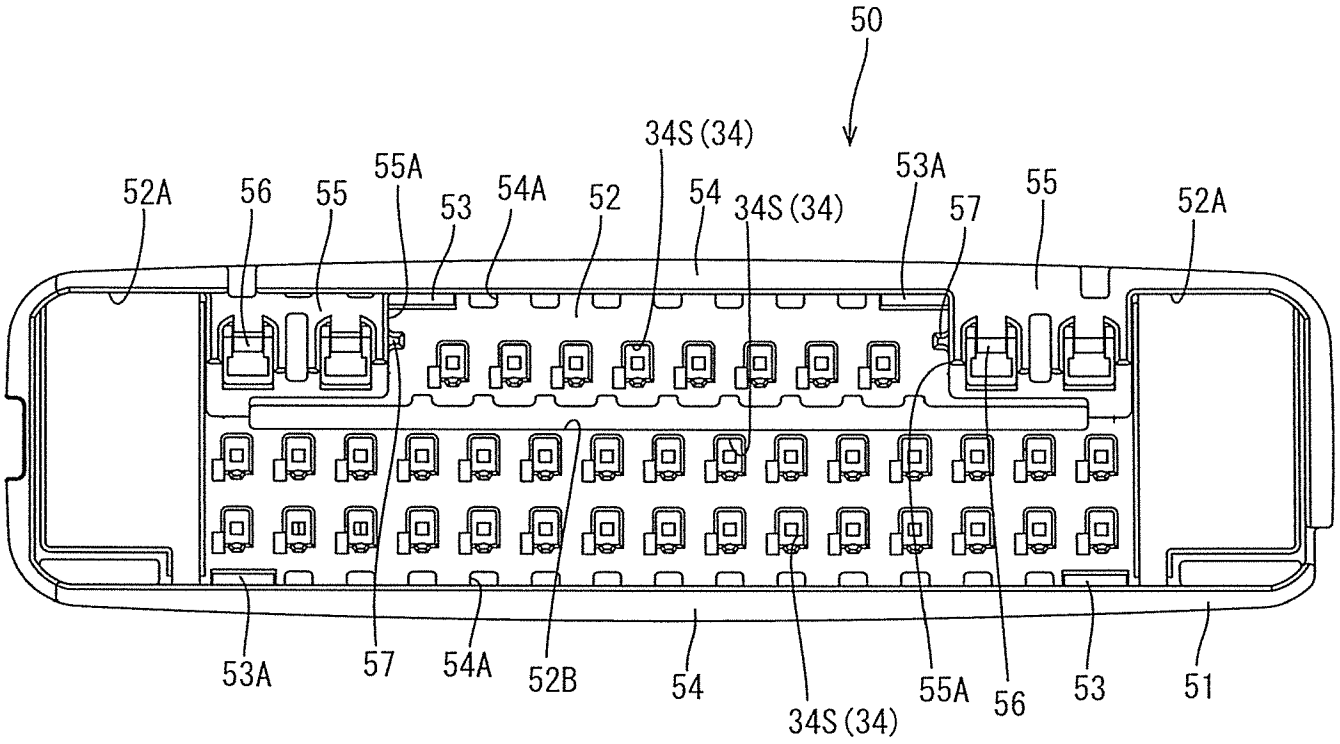
FIG. 14 is a rear view of the front holder.

As shown in FIG. 14, the surrounding portion 51 is a tube having a substantially rectangular shape in a rear view. The front holder 50 is assembled to the terminal accommodating portion 31 so that the surrounding portion 51 surrounds the terminal accommodating portion 31 over the entire periphery and retains the rubber ring G2 of the seal tower 37, as shown in FIGS. 3 to 6 and 8. Further, as shown in FIGS. 1 and 13, slits 54A extend back from the front end edges of the upper and lower facing walls 54 of the surrounding portion 51 and vertically face each other.

Figure 8:
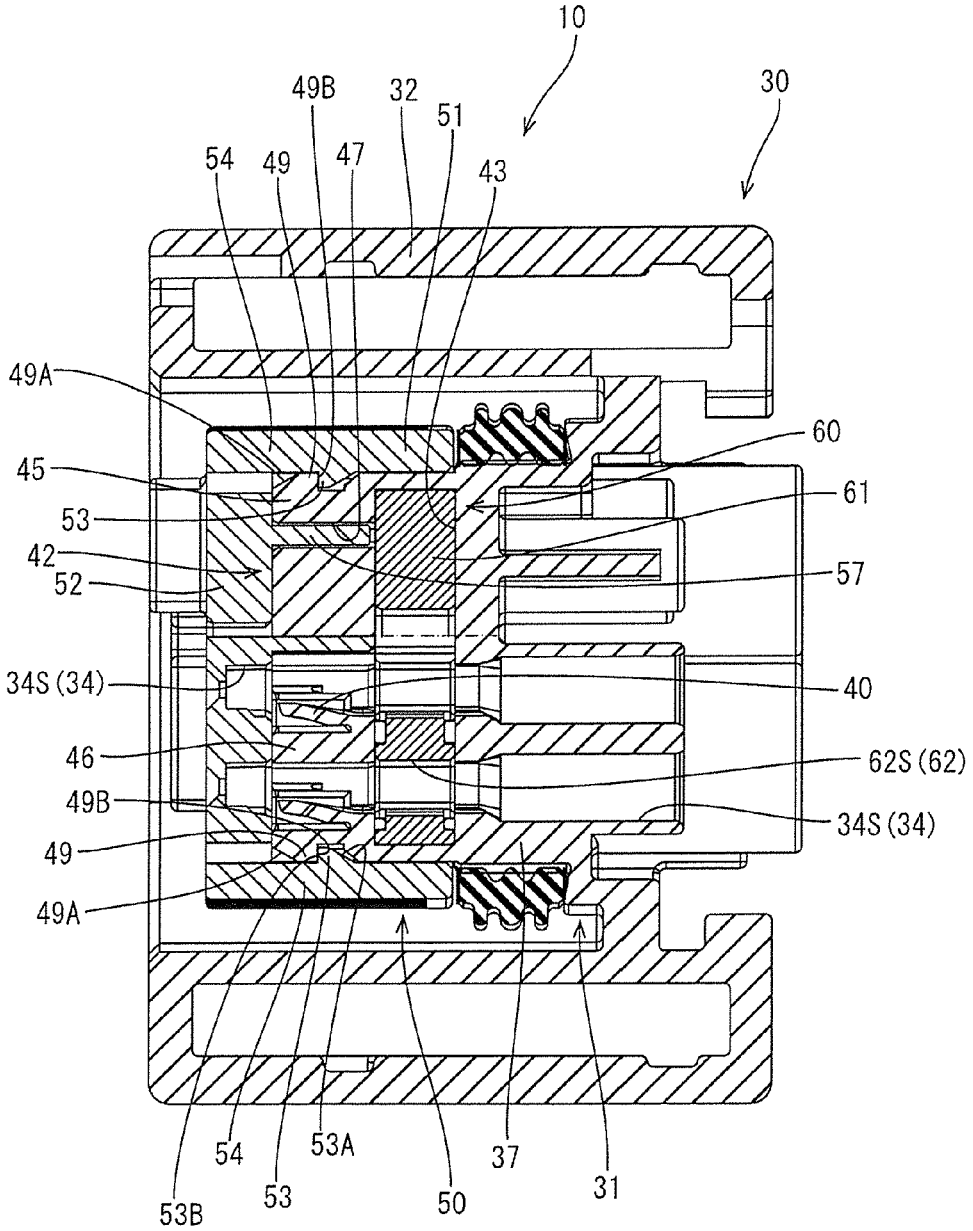
FIG. 8 is a section of the connector taken along line D-D of FIG. 7.

As shown in FIGS. 8 and 14, locks 53 are provided on the upper facing wall 54 and lock to locked portions 49 on opposite lateral sides of the upper surface of the narrow portion 45, and locks 53 are provided on the lower facing wall 54 and lock to locked portions 49 provided on opposite lateral sides of the lower surface of the wide portion 46.

As shown in FIG. 8, each lock 53 has a riding surface 53A inclined inward as it extends forward from the inner surface of the facing wall 54 and a locking surface 53B extending perpendicularly toward the facing wall 54 from a front end part of the riding surface 53A. On the other hand, each locked portion 49 has an inclined surface 49A inclined outward toward the back and a locked surface 49B extending slightly back along the central tower 42 from the rear end edge of the inclined surface 49A and then extending vertically toward the central tower 42 from the rear end edge of the backward extending part.

The riding surfaces 53A of the locks 53 move onto the inclined surfaces 49A of the locked portions 49 from the front when the front holder 50 is assembled into the terminal accommodating portion 31. The locks 53 move over the locked portions 49 when the front holder 50 reaches a proper mount position with respect to the terminal accommodating portion 31. Then, as shown in FIG. 8, the locking surfaces 53B of the locks 53 and the locked surfaces 49B of the locked portions 49 are locked to each other in the front-back direction. Thus, the front holder 50 is mounted so as not to come out from the terminal accommodating portion 31.

As shown in FIGS. 4 and 8, the front wall 52 is a flat plate that vertically connects front edges of the upper and lower facing walls 54. When viewed from the front and back, the front wall 52 has substantially the same shape as the central tower 42 with an upper half that is narrower than the lower half, as shown in FIGS. 1 and 14. Tower insertion holes 52A are formed by left and right side surfaces of the front wall 52 and the surrounding portion 51 on opposite lateral sides of the front wall 52 to allow passage of the lateral towers 41.

A laterally long through hole 52B penetrates a central part of the front wall 52 in the front-back direction. A substantially lateral central part of the through hole 52B communicates with the fitting recess 42A of the central tower 42 when the front holder 50 is mounted into the terminal accommodating portion 31 and the front wall 52 is mounted on the front end surface of the central tower 42, as shown in FIG. 4. The mating fitting portion of the mating connector is fit into the fitting recess 42A of the central tower 42 through the through hole 52B.

As shown in FIGS. 4, 5, 6 and 14, small cavities 34S are formed in the front wall 52 and receive the front end parts of the small terminals 20S. The small cavities 34S are arranged in upper, middle and lower stages to communicate with the small cavities 34S of the central tower 42, and the through hole 52 is located between two adjacent stages. The entirety of each small cavity 34S is formed by the front wall 52, the central tower 42 and the seal tower 37 when the front holder 50 is assembled to the terminal accommodating portion 31 and the front wall 52 is mounted on the front end of the central tower 42.

The front terminal accommodating portions 55 are at opposite lateral sides of the small cavities 34S in the upper stage of the front wall 52, as shown in FIGS. 1 and 14. The front terminal accommodating portions 55 are rectangular tubes penetrating in the front-back direction and arranged in the arrangement spaces S when the front holder 50 is mounted to the terminal accommodating portion 31, as shown in FIGS. 5, 6, 9 and 10. The front terminal accommodating portion 55 at one side located on a front in the inserting direction of the retainer 60 (right side in FIGS. 5, 6, 9 and 10) is in the arrangement space S while projecting slightly back from the arrangement space S. A rear part of the front terminal accommodating portion 55 projecting back from the arrangement space S is fit into the escaping portion 68 of the retainer main body 61 from the front, while the rear end surface of the front terminal accommodating portion 55 is near the front end surface of the reinforcement 69 of the escaping portion 68.

The front terminal accommodating portion 55 located on a back side in the inserting direction of the retainer 60 (left side in FIGS. 5, 6, 9 and 10) is configured that the rear end surface thereof is proximate to the front end surface of the seal tower 37 when arranged in the arrangement space S.

That is, as shown in FIGS. 9 and 10, the rear end part of the front terminal accommodating portion 55 on the one side is fit into the escaping portion 68 of the retainer main body 61 from the front. Thus, the rear end part of the front terminal accommodating portion 55 can contact the inner surface of the escaping portion 68 in the lateral direction, which is a withdrawing direction of the retainer 60 to prevent detachment of the retainer 60 from the housing 30 with momentum even when the retainer 60 is displaced swiftly from the full locking position to the partial locking position by operating the operating portion 63.

As shown in FIGS. 4 to 6, two medium cavities 34M are arranged side by side in the lateral direction in each front terminal accommodating portion 55 and are at positions corresponding to the medium cavities 34M of the seal tower 37 in the front-back direction. Thus, the connecting portions 21 of the medium terminals 20M are accommodated in the medium cavities 34M of the front terminal accommodating portion 55. When the front terminal accommodating portions 55 are arranged in the arrangement spaces S, the entire medium cavities 34M are formed by the seal tower 37 and the front terminal accommodating portions 55.

A medium locking lance 56 is provided at the upper surface of each medium cavity 34M of the front terminal accommodating portion 55 and is resiliently displaceable in the vertical direction. The medium locking lance 56 projects straight down from the upper surface of the rear end of the medium cavity 34M and then extends forward from a lower end part of that downwardly projecting part, and a front end part thereof extends obliquely down. That is, the medium locking lance 56 is configured to ensure a vertical resilient displacement while shortening a length in the front-back direction as compared with a locking lance extending obliquely down toward the front from a base end part. When the front holder 50 is mounted into the terminal accommodating portion 31, the front terminal accommodating portion 55 on the one side is fit into the escaping portion 68 and the medium locking lances 56 provided in the front terminal accommodating portion 55 are arranged on a passage path for the retainer main body 61. Further, when the medium terminal 20M is inserted into the medium cavity 34M, the medium locking lance 56 is fit into a lance hole 21B on the connecting portion 21 of the medium terminal 20M to retain the medium terminal 20M so that the medium terminal 20M does not come out backward.

As shown in FIGS. 3, 8 and 14, deformation preventing ribs 57 project on outer side surfaces 55A of the front terminal accommodating portions 55 near the narrow portion 45 and can be fit into deformation preventing recesses 47 on left and right outer side surfaces 45A of the narrow portion 45 respectively. The deformation preventing ribs 57 are arranged below the locks 53 so as to be juxtaposed vertically with the locks 53 and extend straight from the front wall 52 to positions behind the lock 53.

On the other hand, as shown in FIGS. 3, 7 and 8, the deformation preventing recesses 47 of the narrow portion 45 extend straight from the front end of the narrow portion 45 to the retainer accommodation hole 43 while being recessed laterally. The deformation preventing recesses 47 are arranged below the locked portions 49 so as not to be juxtaposed vertically with the small cavities 34S in the narrow portion 45, but to be juxtaposed vertically with the locked portions 49. That is, the locks 53 and the locked portions 49 and the deformation preventing ribs 57 and the deformation preventing recesses 47 are juxtaposed vertically.

The deformation preventing ribs 57 and the deformation preventing recesses 47 start fitting to each other before the locks 53 of the surrounding portion 51 move onto the locked portions 49 of the narrow portion 45 and are set so that the deformation preventing ribs 57 and the inner surfaces of the deformation preventing recesses 47 come into contact with each other in the vertical direction when the locks 53 move onto the locked portions 49.

Specifically, when the locks 53 move onto the locked portions 49, the locks 53 and the deformation preventing ribs 57 vertically sandwich the locked portions 49 and an upper part of the narrow portion 45 provided with the locked portions 49 is supported from below by the deformation preventing ribs 57.

If the cavities 34 and the fitting recess 42A were provided in the terminal accommodating portion 31 and the slits 54A were provided on the facing walls 54, the terminal accommodating portion 31 may incline excessively inward into the cavities 34 and the fitting recess 42A or the facing walls 54 may deflect excessively outward when the locks 53 move onto the locked portions 49. Thus, the terminal accommodating portion and the facing walls may deform plastically.

However, according to this embodiment, when the locks 53 move onto the locked portions 49, the locks 53 and the deformation preventing ribs 57 vertically sandwich the locked portions 49 to prevent the upper facing wall 54 from deflecting excessively away from the deformation preventing ribs 57. Further, the upper part of the narrow portion 45 is provided with the locked portions 49 and is supported from below by the deformation preventing ribs 57. Thus, the upper end part of the narrow portion 45 provided with the locked portions 49 is prevented from deflecting excessively down. In this way, excessive deflection and plastic deformation of the facing walls 54 and the narrow portion 45 can be suppressed and a reduction in locking margins between the locks 53 and the locked portions 49 can be suppressed.

Further, the deformation preventing ribs 57 are connected to the front wall 52 and extend along the front terminal accommodating portions 55 from the front wall 52. Thus, the deformation preventing ribs 57 are reinforced without separate reinforcing portions to reinforce the deformation preventing ribs. In this way, the locked portions 49 can be sandwiched by the reinforced deformation preventing ribs 57 and the locks 53 and the upper end part of the narrow portion 45 provided with the locked portions 49 is supported firmly.

The connector 10 is assembled by initially fitting the rubber ring G2 externally on the outer peripheral surface of the seal tower 37 of the terminal accommodating portion 31.

The retainer 60 then is inserted into the retainer accommodation hole 43 of the central tower 42 and the lateral towers 41 through the retainer insertion hole 36 of the housing 30. The locked portions 44 in the retainer accommodation hole 43 and the partial locking claws 66 of the locking pieces 65 on the retainer 60 then are locked to each other in the lateral direction. In this way, the retainer 60 is held at the partial locking position as shown in FIG. 10.

Subsequently, the rubber ring G2 is retained as shown in FIGS. 4, 5 and 6 by mounting the front holder 50 into terminal accommodating portion 31 so that the lateral towers 41 are inserted into the tower insertion holes 52A and the front wall 52 is mounted on the front end surface of the central tower 42.

In this mounting process, the lateral towers 41 first are inserted into the tower insertion holes 52A and, subsequently, the deformation preventing ribs 57 of the front terminal accommodating portions 55 of the front holder 50 start being fit into the deformation preventing recesses 47 of the central tower 42. Further, the front holder 50 is brought closer to the terminal accommodating portion 31 so that the riding surfaces 53A of the locks 53 contact and move onto the inclined surfaces 49A of the locked portions 49. The deformation preventing ribs 57 and the inner surfaces of the deformation preventing recesses 47 then contact each other in the vertical direction, the locked portions 49 are sandwiched vertically by the locks 53 and the deformation preventing ribs 57 and the upper end part of the narrow portion 45 provided with the locked portions 49 is supported from below by the deformation preventing ribs 57.

If the locks and the deformation preventing ribs and the deformation preventing recesses below the locks to be fit to each other were not provided, the terminal accommodating portion located at inner sides of the locked portions may incline excessively in toward the cavities and the fitting recess and the upper facing wall of the surrounding portion may deflect excessively out. Thus, the terminal accommodating portion and the facing wall could deform plastically.

However, according to this embodiment, the deformation preventing ribs 57 first start being fit into the deformation preventing recesses 47. The locks 53 then move onto the locked portions 49 and the deformation preventing ribs 57 and the inner surfaces of the deformation preventing recesses 47 come into contact with each other in the vertical direction. When a state is reached where the locked portions 49 are vertically sandwiched by the locks 53 and the deformation preventing ribs 57, the upper part of the narrow portion 45 provided with the locked portions 49 is supported from below by the deformation preventing ribs 57.

Specifically, the locks 53 and the deformation preventing ribs 57 vertically sandwich the locked portions 49 when the locks 53 start moving onto the locked portions 49. Thus, the upper facing wall 54 of the surrounding portion 51 cannot deflect excessively away from the deformation preventing ribs 57. Further, the upper part of the narrow portion 45 has the locked portions 49 and is supported from below by the deformation preventing ribs 57. Therefore, the upper part of the narrow portion 45, which is provided with the locked portions 49, cannot deflect excessively. In this way, the facing walls 54 and the narrow portion 45 will not deflect excessively or deform plastically and the locking margins between the locks 53 and the locked portions 49 will not be reduced.

The locks 53 move over the locked portions 49 when the front holder 50 reaches a proper position with respect to the terminal accommodating portion 31. Thus, the locking surfaces 53B of the locks 53 are locked to the locked surfaces 49B of the locked portions 40 in the front-back direction to keep the front holder 50 mounted to the terminal accommodating portion 31, as shown in FIG. 8.

The front terminal accommodating portions 55 enter the arrangement spaces S when mounting the front holder 50 to the terminal accommodating portion 31. Thus, the rear part of the front terminal accommodating portion 55 on the one side is fit into the escaping portion 68 of the retainer main body 61 of the retainer 60 and the front terminal accommodating portion 55 on the one side and the medium locking lances 56 are arranged on the passage path for the retainer main body 61, as shown in FIG. 10. In this way, the small cavities 34S are formed by the seal tower 37, the central tower 42 and the front wall 52 and the medium cavities 34M are formed by the seal tower 37 and the front terminal accommodating portions 55.

An attempt could be made to accommodate a plurality of types of terminals of different sizes in a mixed manner in the terminal accommodating portion and to lock each terminal by the same retainer. However, the locking lances for the respective terminals are not aligned in the front-back direction and the locking lances cannot be provided in the housing if positions where the locking lances are provided overlap the passage path for the retainer.

However, according to this embodiment, the medium locking lances 56 fit into the escaping portion 68 of the retainer main body 61 after insertion of the retainer 60. Thus, the medium locking lances 56 can be arranged on the passage path for the retainer 60. That is, the locking lances 38, 40 and 56 can be provided in the respective cavities 34 even if the locking lances 38, 40 and 56 for the respective terminals 20 are not aligned in the front-back direction and the positions of the medium locking lances 56 overlap the passage path for the retainer 60 by locking the respective terminals 20 by the same retainer 60 while accommodating a plurality of types of terminals 20 having different sizes in a mixed manner in the terminal accommodating portion 31.

After each cavity 34 is formed, the corresponding terminal 20 is inserted into each cavity 34 from behind and locked by the corresponding locking lance 38, 40 or 56. The retainer 60 then is moved from the partial locking position to the full locking position and each terminal lock of the retainer main body 61 doubly locks each terminal 20 together with each locking lance 38, 40 or 56.

To move the retainer 60 from the partial locking position to the full locking position, the operating portion 63 of the retainer main body 61 is pushed and the pushing force is transmitted to the locking pieces 65. As a result, the full locking claws 67 of the locking pieces 65 move over the locked portions 44 of the retainer accommodation hole 43 and the locked portions 44 and the full locking claws 67 are locked to each other in the lateral direction, as shown in FIG. 9.

If the upper opening of the escaping portion of the retainer main body is not closed at all, the escaping portion is deformed to narrow in the lateral direction when the operating portion of the retainer is pushed, and a force from the operating portion may not be transmitted properly to the locking pieces. If the force from the operating portion is not transmitted surely to the locking pieces, the full locking claws are less likely to move over the locked portions even if the operating portion is pushed to a predetermined position, and the retainer cannot move correctly between the partial and full locking positions.

However, according to this embodiment, the reinforcement 69 closes the rear half of the upper opening of the escaping portion 68, as shown in FIG. 12. Thus, the retainer main body 61 will not deform to squeeze the escaping portion 68 and the retainer 60 can be moved reliably to the full locking position when the operating portion 63 is pushed.

Further, the reinforcement 69 is flush with the upper surface of the retainer main body 61 and the locking piece 65 and the reinforcement 69 are juxtaposed in line in the inserting direction of the retainer 60, as shown in FIG. 11. Thus, a force given to the operating portion 63 is transmitted more reliably to the locking pieces 65 as compared with the case where the reinforcement is provided in a substantially vertical central part of the escaping portion.

Finally, the slide lever 35 is accommodated into the receptacle 32 to complete the assembling operation of the connector 10.

As described above, the deformation preventing ribs 57 and the inner surfaces of the deformation preventing recesses 47 contact each other in the vertical direction when the locks 53 move onto the locked portions 49 in the process of mounting the front holder 50 into the terminal accommodating portion 31. Thus, the locked portions 49 are sandwiched vertically by the locks 53 and the deformation preventing ribs 57 and the upper facing wall 54 of the surrounding portion 51 is prevented from being deflected excessively away from the deformation preventing ribs 57.

Further, the upper end part of the narrow portion 45 is provided with the locked portions 49 and is supported from below by the deformation preventing ribs 57. Therefore excessive downward deflection of the upper end part of the narrow portion 45 and the locked portions 49 thereon can be prevented. Specifically, excessive deflection and plastic deformation of the facing walls 54 and the narrow portion 45 is suppressed and a reduction in the locking margins between the lock portions 53 and the locked portions 49 is suppressed.

The locks 53 move onto the locked portions 49 and the deformation preventing ribs 57 and the inner surfaces of the deformation preventing recesses 47 come into contact with each other in the vertical direction after the deformation preventing ribs 57 and the deformation preventing recesses 47 start being fit to each other. Therefore, excessive deflection of the terminal accommodating portion 31 and the upper facing wall can be suppressed reliably as compared with the case where the deformation preventing ribs 57 and the deformation preventing recesses 47 come into contact with each other in the vertical direction after the locks start moving onto the locked portions.

Further, the deformation preventing ribs 57 are connected to the front wall 52 and the front terminal accommodating portions 55 to extend along the front terminal accommodating portions 55 from the front wall 52. Thus, the deformation preventing ribs 57 are reinforced without separate reinforcements. In this way, the locked portions 49 are sandwiched by the reinforced deformation preventing ribs 57 and the locks 53 and the upper end part of the narrow portion 45 provided with the locked portions 49 is supported firmly.

The invention is not limited to the above described and illustrated embodiment. For example, the following embodiments are also included in the technical scope of the present invention.

The connector 10 includes the slidable slide lever 35 in the above embodiment. However, a rotary lever may be provided or no lever may be provided.

The deformation preventing ribs 57 are connected to the front wall 52 and the front terminal accommodating portions 55 and the deformation preventing recesses 47 are provided on the narrow portion 45 in the above embodiment. However, the deformation preventing ribs may be on the front wall and the deformation preventing recesses may be on the wide portion.

Large, medium and small terminals 20 are coexistent in the above embodiment. However, one type of terminal may be accommodated or two, four or more types of terminals having different sizes may be coexistent.

LIST OF REFERENCE SIGNS

10: connector
20: terminal

31: terminal accommodating portion
34: cavity
47: deformation preventing recess (accommodating portion side deformation preventing portion)
49: locked portion
50: front holder
52: front wall
53: lock
55: front terminal accommodating portion
57: deformation preventing rib (holder side deformation preventing portion)

What is claimed is:

1. A connector comprising: a terminal accommodating portion made of synthetic resin and provided with cavities into which terminals are accommodated from behind, and a front holder made of synthetic resin mounted into the terminal accommodating portion, wherein:

the front holder including a lock that moves onto a locked portion provided on an outer surface of the terminal accommodating portion as the front holder is being mounted into the terminal accommodating portion and moves over the locked portion and fixes the front holder to the terminal accommodating portion by being locked to the locked portion when the front holder reaches a proper mount position with respect to the terminal accommodating portion;

the terminal accommodating portion including an accommodating portion side deformation preventing portion to be fit to a holder side deformation preventing portion provided on the front holder in a convexo-concave manner; and the holder side deformation preventing portion and the accommodating portion side deformation preventing portion contacting each other in a direction in which the lock moves onto the locked portion when the lock moves onto the locked portion, thereby suppressing excessive deflection of the front holder or the terminal accommodating portion.

2. The connector of claim 1, wherein:

the accommodating portion side deformation preventing portion is juxtaposed with the locked portion in a direction in which the holder side deformation preventing portion and the accommodating portion side deformation preventing portion contact each other, and is arranged at an inner side of the locked portion in the terminal accommodating portion.

3. The connector of claim 2, wherein the holder side deformation preventing portion is juxtaposed with the lock in the direction in which the holder side deformation preventing portion and the accommodating portion side deformation preventing portion contact each other, and is arranged at an inner side of the lock in the front holder.

4. The connector of claim 3, wherein the front holder includes a front wall forming a front part of the terminal accommodating portion.

5. The connector of claim 4, wherein the accommodating portion side deformation preventing portion is a deformation preventing recess longer than the locked portion in a front-back direction and formed by recessing an outer surface of the terminal accommodating portion.

6. The connector of claim 5, wherein:

the holder side deformation preventing portion is a deformation preventing rib longer than the lock in the front-back direction and projecting back from the front wall; and the deformation preventing recess and the deformation preventing rib are fitted in a convexo-concave manner before the lock moves onto the locked portion.

7. The connector of claim 6, wherein:

the front wall includes a front terminal accommodating portion forming one of the plurality of cavities and extending backward; and the deformation preventing rib is continuous along the front terminal accommodating portion.

* * * * *